United States Patent [19]

Fukae et al.

[11] Patent Number: 4,752,805

[45] Date of Patent: Jun. 21, 1988

[54] TONER RECYCLING UNIT

[75] Inventors: Kensuke Fukae, Monsey, N.Y.; Keitaro Yamashita, Kumagaya, Japan

[73] Assignee: Kentek Information Systems, Inc., Allendale, N.J.

[21] Appl. No.: 77,593

[22] Filed: Jul. 24, 1987

[51] Int. Cl.[4] ..... G03G 15/08

[52] U.S. Cl. ..... 355/3 DD; 355/14 D; 355/15

[58] Field of Search ..... 355/3 DD, 14 D, 15

[56] References Cited

U.S. PATENT DOCUMENTS

| | | | |
|---|---|---|---|
| 4,395,114 | 7/1983 | Ura et al. | 355/15 |
| 4,428,665 | 1/1984 | Hays | 355/15 |
| 4,436,412 | 3/1984 | Yamagata et al. | 355/15 |
| 4,593,997 | 6/1986 | Fox et al. | 355/3 DD X |
| 4,601,569 | 7/1986 | Garris | 355/15 |
| 4,696,565 | 9/1987 | Imanaka | 355/3 DD X |

*Primary Examiner*—A. C. Prescott

*Attorney, Agent, or Firm*—Marmorek, Guttman & Rubenstein

[57] ABSTRACT

A device for recycling residual developer particles which are removed from a photoconductive element by a cleaning unit in an electrographic copier or printer is disclosed. The device comprises a first tube connected to the cleaning unit and a second tube which is connected to the first tube and leads to the developer unit. The second tube is disposed along the developer unit. The residual particles are transferred from the cleaning device through the first tube and into the second tube. The second tube is provided with holes spaced at predetermined distances from each other. The residual particles fall through these holes and co-mingle with developer material stored in the developer unit. In a preferred embodiment, the holes increase in size as one goes along the second tube. In another preferred embodiment, an auger is used to deliver the residual particles to the first tube. A second auger is disposed within the second tube to move the residual particles over the holes. An even distribution of residual particles within the developer unit is thereby attained.

16 Claims, 4 Drawing Sheets

TONER RECYCLING UNIT

BACKGROUND OF THE INVENTION

The present invention relates to a toner recycling unit for recycling residual developer particles which are removed from a photoconductive element of an electrographic copier or printer. More particularly, the present invention relates to an apparatus which returns residual developer particles which have been removed from a photoconductive element by a cleaning device to a container holding the developer material.

In the process of electrophotographic or xerographic printing, a photoconductive member is employed to record an image. The photoconductive member, which typically is in the form of a belt or a drum, is charged to a substantially uniform potential to sensitize its photosensitive surface. In the case of a copying machine, the charged portion of the photosensitive surface is exposed to a reflected light image of an original document to be reproduced. The light image is recorded as an electrostatic latent image on the photoconductive member corresponding to the informational areas contained on the original document.

In the case of a printer connected to a computer, a similar process is used to record information on the photoconductive member. The charged portion of the photoconductive surface is exposed to a light image, the shape of which is controlled by input signals from the computer. For example, a laser or an LED array receiving input signals from the computer functions as an optical print head and illuminates the photoconductive member with a light image of a particular shape. Here too, an electrostatic latent image corresponding to desired informational areas is recorded on the photoconductive member.

After recording the electrostatic latent image on the photoconductive member, the latent image is developed by bringing a developer material or toner into contact with it. The developer material comprises triboelectrically charged toner particles and may also include carrier particles. The charged toner particles are attracted to the electrostatic latent image and form a powder or developed image on the photoconductive member corresponding to the electrostatic latent image. The developed image is subsequently transferred to a sheet of recording medium, such as a sheet of paper. Thereafter, the developed image is permanently affixed to the sheet in image configuration by a variety of methods, such as by fusing.

The above-mentioned operations may be carried out by arranging a number of stations in sequence about the photoconductive member. Thus, the photoconductive member is usually surrounded in sequence by a charging station to charge the photoconductive member, an imaging station to form an electrostatic latent image on the photoconductive member, a developing station to develop the electrostatic latent image on the photoconductive member, and a transfer station to transfer the developed image from the photoconductive member to the sheet of recording medium. A discharging station and a cleaning station are also arranged about the photoconductive member to ready it for use again.

As used herein, the term "electrographic printing apparatus" and the like are intended to include both copying and printing machines. Such machines include a developer unit operative to deliver toner to the photoconductive member. Typically the toner is stored in a storage compartment where it is mixed with a suitable carrier. The carrier often comprises iron or other metal particles. When mixed with the carrier, the toner acquires a suitable electrostatic charge so that it may easily be transferred to the photoconductive element to develop the latent electrostatic image formed thereon.

Usually, a cleaning device is also installed in the electrographic printing apparatus in order to remove toner and other developer particles which remain on the surface of the drum or the belt after the transfer of the developed image to the sheet of recording medium. In some cases, the cleaning device is integrated into the developer unit which alternately functions in either a developing or a cleaning mode. A variety of devices and methods have been used to clean residual developer particles from the photoconductive belt or drum.

For instance, one such cleaning device which is well known in the art comprises a brush which is used to remove the developer particles. The brush has a length substantially equal to the width of the photoconductive element in order that the entire photoconductive element be swept clean. The cleaning brush is formed using a suitable material to attract the toner particles, and it is positioned to face the photoconductive element so that it may contact its surface in order to remove the residual developer material.

In another well-known method of cleaning the photoconductive element, a scraper blade is applied to the photoconductive element. The scraper blade, typically made from a hard rubber material, is held against the photoconductive element and scrapes it free of residual toner particles. The residual developer particles which have thus been removed from the photoconductive element are then transferred from the cleaning device and discarded.

Thus, in many prior art devices the residual developer particles are scraped off by a blade or the like and are then discharged and discarded to the outside.

A more economical measure is to reuse the residual developer particles which have been removed from the photoconductive element by the cleaning device. As previously related, these residual particles consist of the carrier, which often comprises iron or other metal particles, and toner which did not transfer to the sheet of recording medium.

Heretofore, a variety of devices and methods have been used to recycle these residual developer particles. However, these devices and methods are often complex in structure and fail to provide an even distribution of the recycled developer particles within the developer unit which stores the developer particles. An even distribution of the residual particles throughout the developer unit is important so that some areas of the developer unit aren't emptied of developer material before other areas. This would result in uneven printing.

Accordingly, it is an object of the present invention to provide an apparatus for recycling residual developer particles which have been removed from a photoconductive member to a developer unit.

It is a further object of the present invention to provide an apparatus which maximizes the reuse of residual developer particles and does not suffer from the deficiencies of prior art recycling devices.

In particular, it is an object of the present invention to provide a recycling apparatus which is simple and cheap to construct, and can be attached to a disposable photoconductive belt assembly.

It is yet another object of the present invention to provide a recycling apparatus which provides an even distribution of the residual developer particles within the storage compartment which stores the developer particles.

SUMMARY OF THE INVENTION

In accordance with the present invention, a recycling device for the transfer of residual developer particles from a photoconductive element to a developer unit is provided. The recycling device includes a first tube which receives the residual particles from the cleaning device and transports the same to a second tube substantially disposed along the developer unit. From the second tube, the residual particles are released into the developer unit by means of a series of holes which are spaced at predetermined distances from each other.

In a preferred embodiment, an auger is disposed adjacent to the first tube and rotates in order to carry or drive the residual particles into the first tube.

In another preferred embodiment, an auger is disposed within the second tube, the purpose of which is to aid in the transport and even distribution of the residual particles within the developer unit.

In a further preferred embodiment, the holes which are disposed in the second tube increase in diameter as one proceeds to its furthest portion from the first tube. By providing holes with increasing diameters spaced apart at predetermined distances, an even more precise distribution of residual particles is provided to all areas of the developer unit.

DETAILED DESCRIPTION OF PREFERRED EMBODIMENT

The assignee of the present invention has disclosed and claimed a high speed electrographic printer/copier and components thereof in a number of patent applications. A basic objective of the assignee has been to design the electrographic printer/copier from modular components. These modular components can be easily replaced when their useful lives have been exceeded or when they become defective. The electrographic printer/copier is described in application Ser. No. 700,813, filed Feb. 11, 1985, now U.S. Pat. No. 4,664,507. A photoconductive belt in the form of a disposable cassette with a charging unit attached thereto is described in application Ser. No. 718,947, filed Apr. 2, 1985, now U.S. Pat. No. 4,657,369. A developer unit containing a disposable toner cartridge is described in application Ser. No. 718,946, filed Apr. 2, 1985, now U.S. Pat. No. 4,639,116. A paper input cassette is disclosed in application Ser. No. 718,945, filed Apr. 2, 1985. Two different modular cleaning units for attachment to the photoconductive belt are described in application Ser. No. 033,458, and application Ser. No. 033,457, both of which were filed on Apr. 1, 1987. An electrographic printer/copier containing these modular cleaning units is disclosed in application Ser. No. 033,456, also filed Apr. 1, 1987. All of the foregoing patents and patent applications are incorporated herein by reference.

Figure 1:
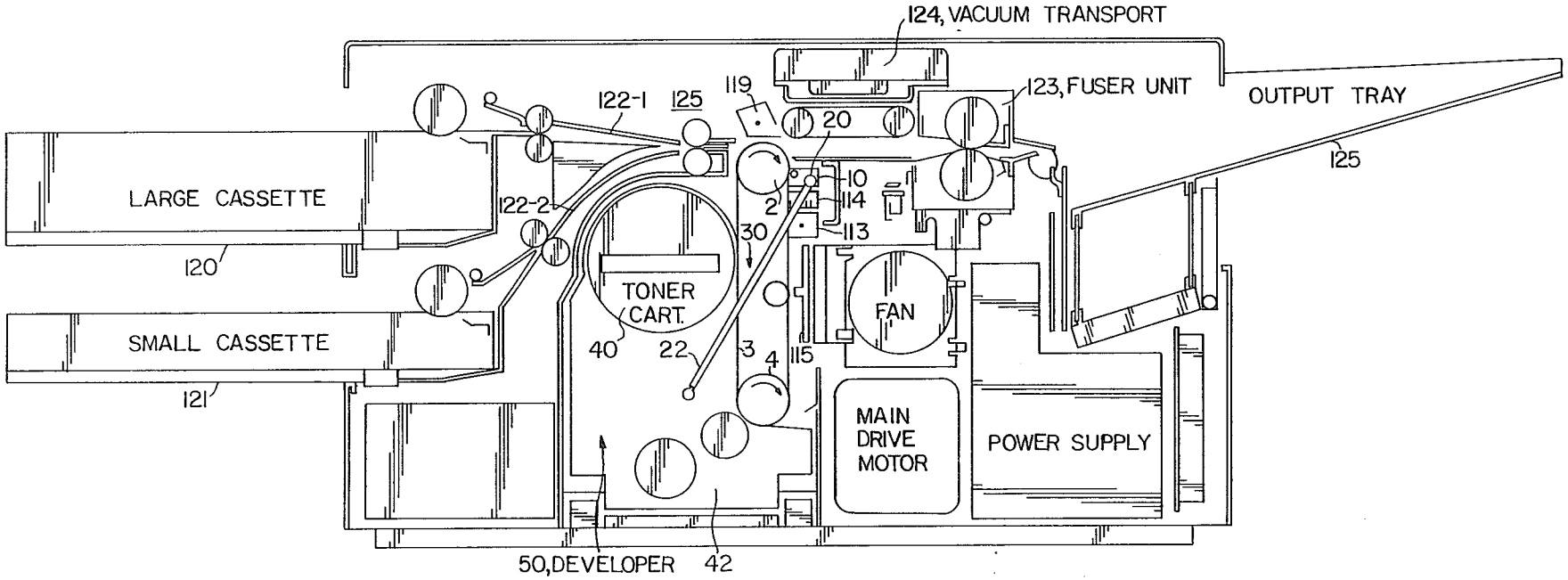
FIG. 1 is a schematic diagram of an electrographic printer employing the recycling device of the present invention.

FIG. 1 is a block diagram showing the basic components of an electrographic printer which incorporates the novel recycling device of the present invention. This electrographic printer is similar in construction to that described in U.S. Pat. No. 4,664,507. It employs the vertically mounted disposable cassette described in U.S. Pat. No. 4,657,369, the developer unit described in U.S. Pat. No. 4,639,116, and a modular cleaning unit.

The printer illustrated in FIG. 1 includes photoconductive belt 3 which is rotated clockwise by means of rollers 2 and 4. Located along the right side of the belt, as viewed in FIG. 1, are the cleaning unit 10, erase lamps 114, main charger 113, and an optical print head 115. The recycling unit, generally depicted as 30, connects cleaning unit 10 to developer unit 50. On the left side of the recycling unit is a replaceable toner cartridge 40 which is disposed within developer unit 50. Located at the top of the belt path is a transfer unit 119, which unit creates an electric field to attract toner from photoconductive belt 3 onto the underside of sheets of paper passing through the image transfer region 125.

The copy material, e.g., paper, is derived from either of two convenient paper handling cassettes 120 and 121. The paper is directed along either of two paper paths 122-1 or 122-2 to the image transfer region 125 located between the upper roller 111 and the transfer unit 119. From the image transfer region 125, the paper is then transported to a fuser unit 123 by means of a vacuum transport unit 124 and finally deposited in an output tray 125.

Figure 2:
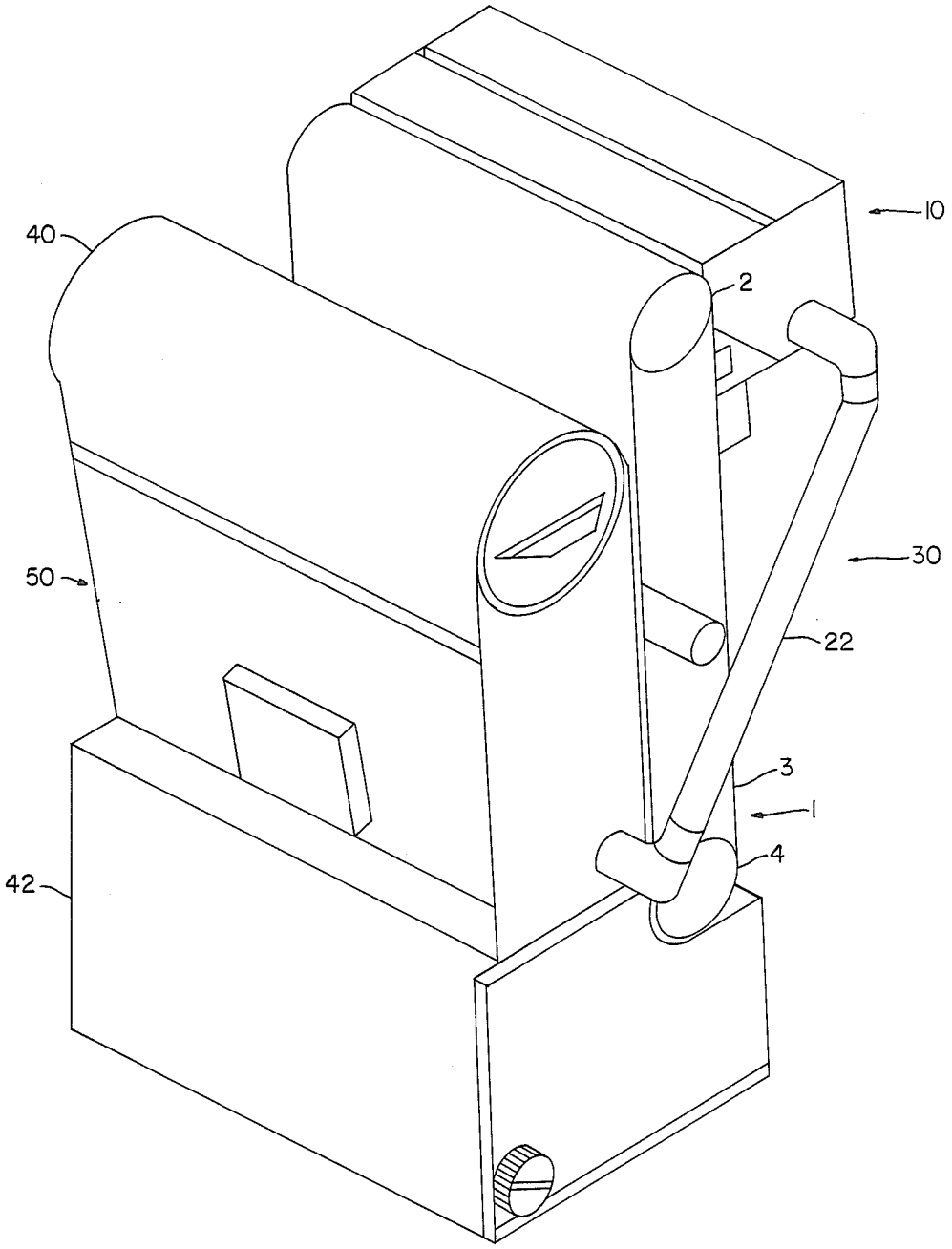
FIG. 2 illustrates the connection of the recycling device of the present invention between a cleaning unit and a storage compartment.

Referring now to FIG. 2, the relationship of the recycling device, generally shown as 30, to photoconductive element 1 and cleaning device 10 is illustrated. The cleaning device 10 is mounted as a modular unit or station on the photoconductive belt assembly 1. It is located after the transfer station in the electrographic printing apparatus and removes residual particles from the photoconductive belt 3.

Figure 3:
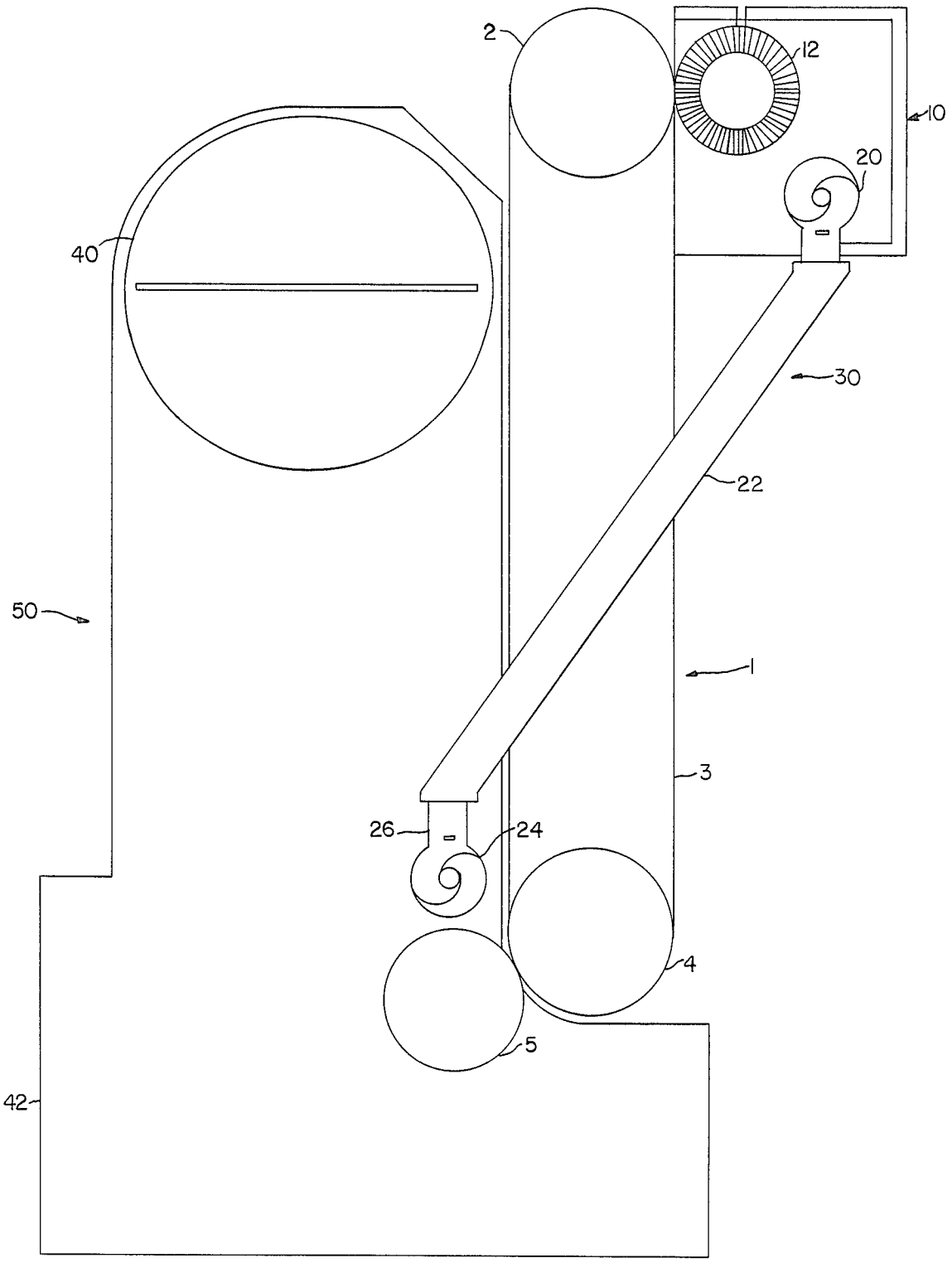
FIG. 3 is a cross-sectional view of the recycling device.

The cleaning device 10 as shown in FIG. 3 includes a cleaning brush 12 of a length which is substantially equal to the width of the photoconductive belt 3. Such a cleaning brush, as is well known to those skilled in the art, is often made from a fur material such as a suitable acrylic material. Because brush 12 is soft, the life of the photoconductive belt 3 is increased.

The residual particles are removed by means of fur brush 12. In order to extend the life of developer unit 50 and to minimize the loss of developer material, the residual particles are recycled by means of recycling unit 30. The recycling unit 30 comprises an auger 20, herein depicted as being disposed within cleaning device 10, a first tube 22 connecting cleaning unit 10 to developer unit 50, a second tube 26 disposed substantially horizontally within the electrophotographic printer, and a second auger 24 disposed within tube 26. Tube 22 is connected at one end to cleaning device 10 and at an opposite end to tube 26.

Figure 4:
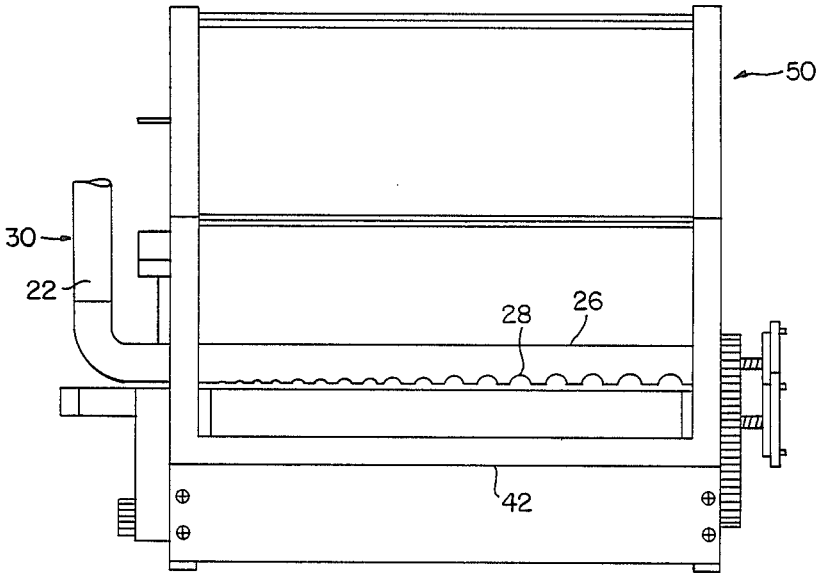
FIG. 4 is a cross-sectional view of a developer unit and the second tube of the present invention.

As shown in FIG. 4, wherein auger 24 has been removed for purposes of clarity, tube 26 is substantially disposed within developer unit 50. Tube 26 runs along developer 50 atop a reservoir of developer materials. The underside of tube 26 is provided with holes 28.

Figure 5:
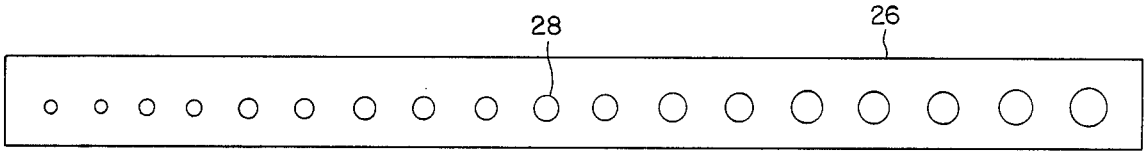
FIG. 5 is an enlarged view of the underside of the second tube shown in FIG. 4.

These holes 28, which are more accurately depicted in FIG. 5, are spaced apart along tube 26 at predetermined distances and increase in diameter along the length of tube 26, the holes at the furthest end from tube 22 being the largest. Thus, the residual particles are able to fall through the holes 28 in tube 26 and into the developer unit 50, where the residual particles co-mingle with the stored developer material. Furthermore, the holes 28 increase in size along the length of tube 26 in order to even out distribution of the recycled residual particles as they fall through holes 28. Thus, at the input end of tube 26 where the volume of recycled particles is high, the holes are small, while at the far end of tube 26, the holes are much larger.

The developer unit 50 depicted herein is similar to the developer unit which is disclosed and claimed in the present assignee's application Ser. No. 718,946, filed Apr. 2, 1985, now U.S. Pat. No. 4,639,116. It includes a disposable toner cartridge 40, storage compartment 42 and a magnetic brush 5 which applies the developer material to the photoconductive belt 3. Toner which is present within the toner cartridge 40 is supplied in controlled amounts to the storage compartment 42, which contains the carrier for the toner. When the toner particles and carrier particles are mixed together within the storage compartment 42, opposite triboelectric charges are formed on the carrier and toner particles. Magnetic brush 5 moves the toner carrier mix from storage compartment 42 and delivers the toner in the mix to the photoconductive belt 3.

The operation of the printer depicted in FIG. 1 involves a single rotation of the belt 3 per copy produced. During this rotation, the belt 3 is uniformly charged as it passes main charger 113. A latent image is generated by means of the optical print head 115, which can be either a laser or an LED array. The optical print head 115 serves to discharge selected portions of the uniformly charged photoconductive belt 3 as it moves past the optical print head 115. The electrostatic latent image thus formed is developed by the deposition of the toner from the developer unit 50. Illustratively, the toner is deposited only on the discharged portions of the photoconductive belt 3. The belt 3 then enters the transfer region 125 wherein the developed image is transferred to the underside of the paper. In the transfer region 125, the transfer unit 119 serves to form an electric field which attracts toner from the photoconductive belt to the underside of the paper. The toner image is then fused to the paper by means of the fuser unit 123 and ejected into output tray 125 printed side down.

As the belt 3 continues to rotate following image transfer, it immediately enters into the region of cleaning device 10. The cleaning device is desirably in the form depicted in application Ser. No. 033,457, filed Apr. 1, 1987, although it may also be of any other kind known to those skilled in the art. The residual particles are removed from the belt 3 and the belt is uniformly discharged by erase lamps 114. The belt 3 is thereby readied for the next copy.

The residual developer particles remaining on the photoconductive belt 3 after a developed image has been transferred from the photoconductive belt 3 to paper are removed by fur brush 12. These particles are funnelled into the windings of auger 20. Auger 20 rotates to carry or drive the residual particles toward tube 22, thereby transporting the residual particles out of cleaning device 10 and into tube 22.

Tube 22 receives the residual particles from the cleaning device 10 via auger 20 and transports the particles downwardly along its length due to gravity into tube 26. Auger 24 rotates to carry or drive the residual particles horizontally along the length of tube 26. As the residual particles travel along tube 26, they fall through holes 28 provided on the underside of tube 26 into reservoir 42 of developer unit 50. Due to the varying size of the holes 28 and their positioning in relation to one another in tube 26, a more even distribution of the residual particles is achieved along the length of developer unit 50.

While the invention has been described by reference to specific embodiments, this was for purposes of illustration only and should not be construed to limit the spirit or the scope of the invention.

What is claimed is:

1. An apparatus for recycling residual particles from a photoconductive member to a developer unit in an electrographic printer, comprising cleaning means for removing said residual particles from a photoconductive member, first conveying means connected to said cleaning means, said first conveying means transporting said residual particles away from said cleaning means, and second conveying means connected to said first conveying means, said second conveying means receiving said residual particles from said first conveying means and delivering them to a developer unit, said second conveying means being disposed along said developer unit, said second conveying means including apertures spaced apart at predetermined distances for distributing said residual particles evenly in said developer unit.

2. The apparatus of claim 1, wherein said second conveying means includes a first end connected to said first conveying means and a second end, said apertures increasing in size from said first end to said second end.

3. The apparatus of claim 2, further comprising a first transferring means adjacent to said first conveying means, said first transferring means transferring said residual particles from said cleaning means into said first conveying means.

4. The apparatus of claim 3, further comprising second transferring means for moving said residual particles along a length of said second conveying means.

5. The apparatus of claim 4, wherein said first and second transferring means are augers.

6. The apparatus of claim 1, wherein said first and second conveying means are tubes.

7. The apparatus of claim 1, wherein said developer unit includes a storage compartment for storing developer material, said second conveying means being substantially disposed within said storage compartment so that said recycled residual particles are distributed evenly in said storage compartment.

8. An apparatus for recycling residual particles from a photoconductive member to a developer unit in an electrographic printer, comprising cleaning means for removing said residual particles from a photoconductive member, first conveying means connected to said cleaning means, said first conveying means transporting said residual particles away from said cleaning means, first transferring means adjacent to said first conveying means, said first transferring means transferring said residual particles from said cleaning means into said first conveying means, second conveying means connected to said first conveying means, said second conveying means receiving said residual particles from said first conveying means and delivering them to a developer unit, and second transferring means disposed along said second conveying means for moving said residual particles within said second conveying means, said second conveying means being disposed along said developer unit, said second conveying means including apertures spaced apart at predetermined distances for distributing said residual particles evenly in said developer unit.

9. The apparatus of claim 8, wherein said second conveying means includes a first end connected to said first conveying means and a second end, said apertures increasing in size from said first end to said second end.

10. The apparatus of claim 8, wherein said first and second conveying means are tubes.

11. The apparatus of claim 8, wherein said first and second transferring means are augers.

12. The apparatus of claim 8, wherein said developer unit includes a storage compartment for storing developer material, said second conveying means being substantially disposed within said storage compartment so that said recycled residual particles are distributed evenly in said storage compartment.

13. An apparatus for recycling residual particles from a photoconductive member to a developer unit in an electrographic printer, comprising cleaning means for removing said residual particles from a photoconductive member, first conveying means connected to said cleaning means, said first conveying means transporting said residual particles away from said cleaning means, first transferring means adjacent to said first conveying means, said first transferring means transferring said residual particles from said cleaning means into said first conveying means, second conveying means connected to said first conveying means and being disposed along said developer unit, said second conveying means receiving said residual particles from said first conveying means and delivering them to a developer unit, said second conveying means including a first end connected to said first conveying means and a second end, said second conveying means including apertures spaced apart at predetermined distances for distributing said residual particles evenly in said developer unit, said apertures increasing in size from said first end to said second end, and second transferring means disposed within said second conveying means for moving said residual particles within said second conveying means.

14. The apparatus of claim 13, wherein said first and second conveying means are tubes.

15. The apparatus of claim 13, wherein said first and second transferring means are augers.

16. The apparatus of claim 13, wherein said developer unit includes a storage compartment for storing developer material, said second conveying means being substantially disposed within said storage compartment for storing developer material, said second conveying means being disposed along said storage compartment so that said recycled residual particles are distributed evenly in said storage compartment.

* * * * *